US005453016A

United States Patent [19]

Clark et al.

[11] Patent Number: 5,453,016

[45] Date of Patent: Sep. 26, 1995

[54] RIGHT ANGLE ELECTRICAL CONNECTOR AND INSERTION TOOL THEREFOR

[75] Inventors: Stephen L. Clark, Dillsburg; Glenn J. Pontius, New Cumberland, both of Pa.

[73] Assignee: Berg Technology, Inc., Reno, Nev.

[21] Appl. No.: 274,108

[22] Filed: Jul. 12, 1994

Related U.S. Application Data

[63] Continuation-in-part of Ser. No. 152,477, Nov. 15, 1993, abandoned.

[51] Int. Cl.[6] ..... H01R 9/09

[52] U.S. Cl. ..... 439/79; 439/80

[58] Field of Search ..... 439/79–83, 374, 439/381, 733, 751

[56] References Cited

U.S. PATENT DOCUMENTS

| | | | |
|---|---|---|---|
| 3,333,225 | 7/1967 | McNutt | 339/17 |
| 3,601,762 | 8/1971 | Eshelman | 439/79 X |
| 4,050,769 | 9/1977 | Ammon | 339/196 |
| 4,367,583 | 1/1983 | Baccei | 29/739 |
| 4,503,610 | 3/1985 | Fesch | 29/845 |
| 4,550,962 | 11/1985 | Czeschka | 339/17 |
| 4,652,066 | 3/1987 | Pelzl et al. | 439/79 X |
| 4,744,771 | 5/1988 | Uchida | 439/733 |
| 4,857,017 | 8/1989 | Erk | 439/695 |
| 4,871,321 | 10/1989 | Johnson | 439/79 |
| 4,955,819 | 9/1990 | Harting et al. | 439/79 |
| 5,076,795 | 12/1991 | Krupp | 439/83 X |
| 5,147,226 | 9/1992 | Kile | 439/374 X |
| 5,213,514 | 5/1993 | Arai | 439/79 |
| 5,252,080 | 10/1993 | Pesson | 439/79 |
| 5,259,773 | 11/1993 | Champion et al. | 439/79 X |
| 5,354,219 | 10/1994 | Wanjura | 439/79 X |

FOREIGN PATENT DOCUMENTS

| | | | |
|---|---|---|---|
| 3925958 | 2/1991 | Germany | 439/79 |
| 5109444 | 4/1993 | Japan | 439/374 |
| 2219148 | 11/1989 | United Kingdom | 439/79 |

OTHER PUBLICATIONS

"The drawing depicts parts sold in the United States as early as May 1993."

*Primary Examiner*—William Briggs

*Attorney, Agent, or Firm*—Woodcock, Washburn, Kurtz, Mackiewicz & Norris

[57] ABSTRACT

Disclosed is a multi-row right angle connector and a press block for installing the connector on a mounting substrate without soldering the contact pins. The connector legs comprise "eye of the needle" compliant interfaces that make electrical contact with the interior surfaces of the substrate's plated through holes. The press block is designed for use with a four-row right angle receptacle and locates rows 2, 3, and 4 on respective true grid positions and serves as a means for transmitting force from an external press to the contact pin tails. The contact tails in rows 2, 3, and 4 have a T-shaped shoulder that is pressed into a pocket in the press block. The insertion force is applied to the pins in row 1 by a corner having a radius matching the radius of the row 1 tails.

10 Claims, 6 Drawing Sheets

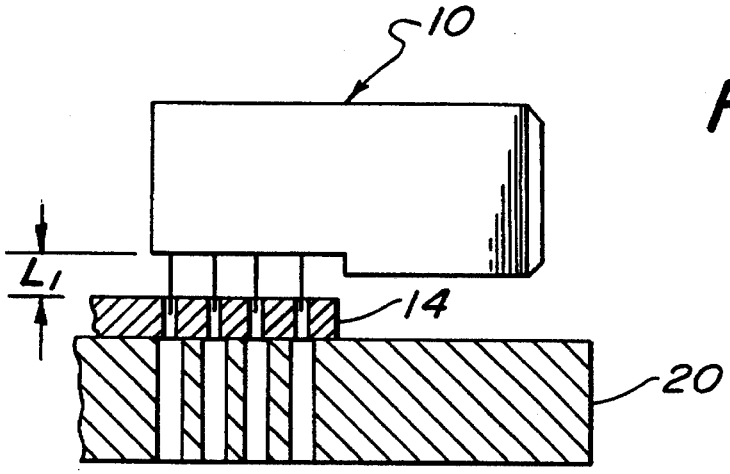
FIG. 7A
FIG. 7B
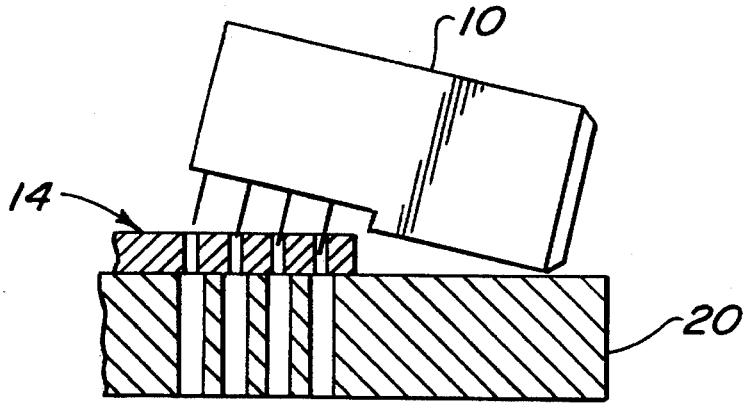
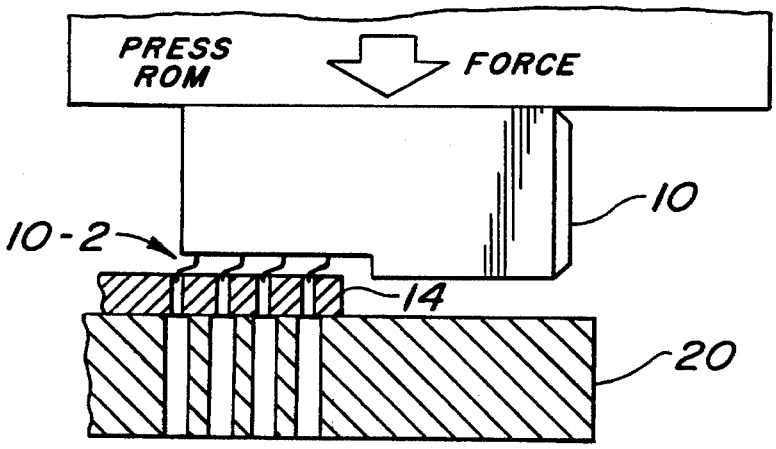
FIG. 7C

RIGHT ANGLE ELECTRICAL CONNECTOR AND INSERTION TOOL THEREFOR

This is a continuation-in-part, of application Ser. No. 08/152,477, filed Nov. 15, 1993, now abandoned.

FIELD OF THE INVENTION

The present invention relates generally to electrical connectors and more particularly to a press fit right angle connector and a press block for insertion of the bent pins of the connector into holes of a mounting substrate.

BACKGROUND OF THE INVENTION

In the past, electrical connectors have included straight-post type contacts secured perpendicularly in a mounting substrate, such as a printed circuit board (PCB). From an electrical packaging standpoint, such an arrangement of mating elements is generally desirable for electrical components, card edge connectors, backpanel assemblies, and related applications wherein the mating conductors may be at right angles to the mounting substrate without extending beyond the allotted space limitations above the substrate.

It is often desirable to be able to press fit the contacts directly into the mounting substrate rather than soldering them. Certain prior art approaches to press fitted contacts have included only straight-post type contacts having rigid, transversely extending load bearing shoulders for receiving and rigidly withstanding the requisite press fit insertion force from an insertion tool. Moreover, certain straight-post contacts have been designed to be press fitted into bores in a mounting substrate and subsequently covered by an insulative housing. An insulative housing which is removable from around the press fitted contacts provides a means of access to those contacts and facilitates repairability.

When a plug connector having bent contact posts for insertion into printed circuit board holes is inserted into a PCB, it is necessary to apply an insertion force on the upper side of the bends of the contact posts. Specifically, it is desirable to provide an insertion force as precisely as possible in an axial direction of the contact posts. The insertion of such plug connectors is especially problematic when the plug connectors are provided in a plurality of parallel rows, such as, for example, in DIN plug connectors or high pin count (HPC) right angle receptacles and headers. In such connectors, the bent contact posts of the various contact rows, viewed in the direction of insertion, are arranged in overlapping fashion upon leaving the insulating member.

U.S. Pat. No. 4,955,819, Sep. 11, 1990, titled "Plug Connector Having Bent Contact Posts for Insertion Into Printed Circuit Board Holes," discloses a plug connector with bent contact posts in combination with a comb-shaped supplemental part having crosspieces for supporting the contact posts. An insertion tool is also disclosed. This patent is briefly summarized below, as is another patent, namely, U.S. Pat. No. 4,550,962. The drawings of these two patents may advantageously be referred to when reading the following summaries, in which the reference numerals in parentheses refer to the elements depicted in the patent drawings.

In U.S. Pat. No. 4,955,819, the disclosed plug connector includes an insulating member (ref. no. 1) with contact elements (ref. no. 2) contained therein. The contact elements are arranged in a plurality of parallel rows. The contact posts (ref. no. 4) project from the insulating member and are bent at right angles. The contact posts are provided at their ends with an insertion section (ref. no. 7) for fastening and making contact in suitable PCB holes. Lateral flanges (ref. no. 9) on the insulating member are provided with bore holes for securing the plug connector to the PCB.

As shown in FIG. 2, the respective rows of contact posts are in each instance arranged directly under and/or above another row of contact posts. To be able to press the contact posts into the holes of the PCB, an insertion force must be exerted on the individual posts, specifically, on the upper side of the post regions running horizontally. To this end, a comb-like supplemental part (ref. no. 10) is provided. The comb-like part is slipped between the contact posts as shown. Crosspieces (ref. no. 13) are formed in the slots with bearing shoulders (ref. no. 12). Purportedly, a plug connector provided with a supplemental part of this kind may be set up on a printed circuit board with the pin-shaped ends (ref. no. 6) of the posts extending into the circuit board holes such that the insertion sections (ref. no. 7) may be pressed into the holes with the aid of a simple insertion tool (ref. no. 17). The insertion tool includes a flat stamper (ref. no. 18) for acting on the surface (ref. no. 15) of the supplemental part (ref. no. 10). A supporting plate (ref. no. 19) prevents the outer post rows from deflecting or buckling outwardly in the operation of insertion.

U.S. Pat. No. 4,550,962, Nov. 5, 1985, titled "Solderless Electrical Connector Assembly," discloses a solderless electrical connector equipped with inserting segments at the free ends of the contact pins. The inserting segments are inserted into bore holes in the PCB by means of an additional insulating member. An insertion tool having guide ducts formed to receive portions of the contact pins is also disclosed. The disclosed connector is designed to eliminate labor intensive soldering connections and to prevent thermal stresses resulting from the soldering process.

The connector assembly comprises an insulative housing (ref. no. 1) for a multiple contact plug (ref. no. 2). A plurality of contact pins (ref. no. 4), each of which includes a connection post (ref. no. 7) having a connection end (ref. no. 3) and a base portion (ref. no. **4*a*) extending perpendicularly to the connection post, are mounted on the contact plug in parallel rows. Each of the connection posts of the contact pins is formed with connection ends (ref. no. 3) and stop members (ref. no. 8) defining stop shoulders 8*a*. The connection posts (ref. no. 7) are shaped for insertion through the bore holes of a PCB. To limit the insertion depth (t), the stop members (ref. no. 8**) have a width (b) enlarged relative to the width (q) of the connection posts.

The connector assembly is also provided with an additional plastic housing (ref. no. 9) serving simultaneously as an insertion tool and as an insulating cover. The housing is provided with a comb-like configuration. A plurality of parallel webs or teeth (ref. no. 11) extend from the housing so as to define cutout portions (ref. no. 10). The cutout portions are formed with base portions (ref. no. **10*a*) and the teeth are formed with free ends (ref. no. 11*b*), which define complementary shoulders (ref. no. 11*a*) adapted to bear against the stop shoulders (ref. no. 8*a*) of the stop members. When it is desired to insert the contact pins into the PCB, the housing (ref. no. 9) is arranged so as to have the contact pins extend within the slots (ref. no. 10**). The base portions of the pins will be located beneath the base portions of the slots and the complementary shoulders of the teeth will engage against the stop shoulders of the stop members. Another prior art electrical connector assembly is disclosed in U.S. Pat. No. 4,871,321, Oct. 3, 1989, titled "Electrical Connector." In this assembly, a tool for applying an insertion force to the contact pins does not form a part of the connector assembly and, consequently, a separate cover and stiffener are needed to insulate the contact pins.

SUMMARY OF THE INVENTION

An object of the present invention is to provide a solderless right angle connector and an associated insertion part, referred to as a "press block," that may also serve as an insulative housing covering the bent contact pins. A further object of the present invention is to provide a simple tool to facilitate the insertion of the connector into a PCB or like mounting substrate.

A connector assembly in accordance with the present invention is capable of solderless connection to a mounting substrate having suitable bore holes. The connector assembly comprises a first insulative housing; a plurality of contact pins each comprising a first section extending in a first direction from the first insulative housing, a second section oriented in a second direction which is generally perpendicular to the first direction, and a third section extending from the second section in the second direction. The contact pins are arranged in a plurality of rows. In addition, the third section of each pin is formed to provide a compliant press fit engagement with a mounting substrate bore hole. The inventive assembly also includes a press block comprising a second insulative housing and slots formed in the second insulative housing to receive the respective contact pins and to apply an insertion force to the pins. The third sections of the contact pins are designed to be press fitted into bore holes of the mounting substrate. In one preferred embodiment of the invention, in a first row the respective contact pins comprise a shoulder section interposed between the second and third sections. The shoulder sections have a lateral dimension, extending in a direction perpendicular to the second direction, which is greater than a corresponding lateral dimension of the second sections. In addition, in a second row the respective contact pins are shoulderless. The press block in this embodiment includes a corner surface having a radius matching a radius of the shoulderless pins. Thus, an insertion force applied to the press block is transmitted to the shoulderless pins by the corner surface of the press block.

An installation fixture in accordance with the present invention comprises a fixture plate; at least one alignment pin, extending upward from the fixture plate, for insertion through mutually aligned alignment holes of a mounting substrate and connector; a resilient pad providing a surface onto which rests a section of the connector extending beyond an end of the mounting substrate. The pad prevents the connector from tipping as its contact pins are inserted into contact holes of the mounting substrate.

An important advantage of the present invention is that it allows for extremely cost effective and reliable assembly of electrical circuits employing connectors mounted on a PCB.

An important distinguishing feature of the present invention is that at least one of the contact pins is press-fitted into a slot in the press block. This feature allows the press block to become attached to and part of the connector assembly. In addition, in preferred embodiments the pocket portions have a depth greater than the length of the shoulder sections. This provides a gap between the shoulder sections and the mounting substrate, thereby avoiding the cutting or shearing of traces on the mounting substrate. These features are lacking in prior art connectors of the type disclosed, e.g., in U.S. Pat. No. 4,871,321.

Another key feature of the present invention is that the above-mentioned first insulative housing includes a lip (10-5 in the drawings) and the second insulative housing of the press block comprises a hook engagement portion for engaging the lip in the first insulative housing. In preferred embodiments of the invention, the lip forms a sidewall of a channel in the first insulative housing, and the hook engagement portion for engaging the lip is narrower than the width of the channel. This provides a space into which a lever-like tool (see FIG. 9) may be inserted for prying the second insulative housing loose from the first insulative housing.

Other features of the present invention are disclosed below.

BRIEF DESCRIPTION OF THE DRAWINGS

FIGS. 7A–7C illustrate the problem addressed by the installation fixture.

DETAILED DESCRIPTION OF PREFERRED EMBODIMENTS

The present invention provides a means for installing a multi-row right angle connector (e.g., a receptacle) onto a mounting substrate (e.g., a PCB) without soldering the contact pins. In a preferred embodiment, the connector legs comprise "eye of the needle" compliant interfaces (sometimes referred to herein as the "third section") that make electrical contact with the interior surfaces of the substrate's plated through-holes. The present invention is particularly useful in (but not limited to) applications involving right angle connectors comprising pins with rectangular, rather than square, cross-sections. Such rectangular pins are more prone than square pins to buckle during insertion into a mounting substrate. In the embodiment described below, a press block designed for use with a four-row HPC right angle receptacle locates rows 2, 3, and 4 on respective true grid positions and serves as a means for transmitting force from an external press to the contact pin tails (the portion extending from the connector body, which is sometimes referred to herein as the "second section"). The contact,tails in rows 2, 3, and 4 have a T-shaped shoulder that is pressed into a pocket in the press block. This feature retains the press block on the pinfield of the connector body. A hook engagement of the press block to the connector body prevents the press block from rocking downward and destroying the pin tip true position, which can result in buckling of the pins under an insertion force.

The insertion force is applied to the pins in row 1 (the pins closest to the mounting substrate) in a different manner. This is due to the extremely close spacing of the row 1 pins to the mounting substrate, which spacing prevents the row 1 pins from being afforded shoulders of the kind provided to the pins of rows 2–4. For example, in one embodiment, the row 1 pins are spaced approximately three-hundredths of an inch (0.030 in.) from the mounting substrate after insertion. According to the present invention, the press block is provided with a corner having a radius matching the radius of the row 1 tails. This feature provides a bearing area on both sides of the row 1 tails and transmits the required installation force to the row 1 tails.

Figure 1:
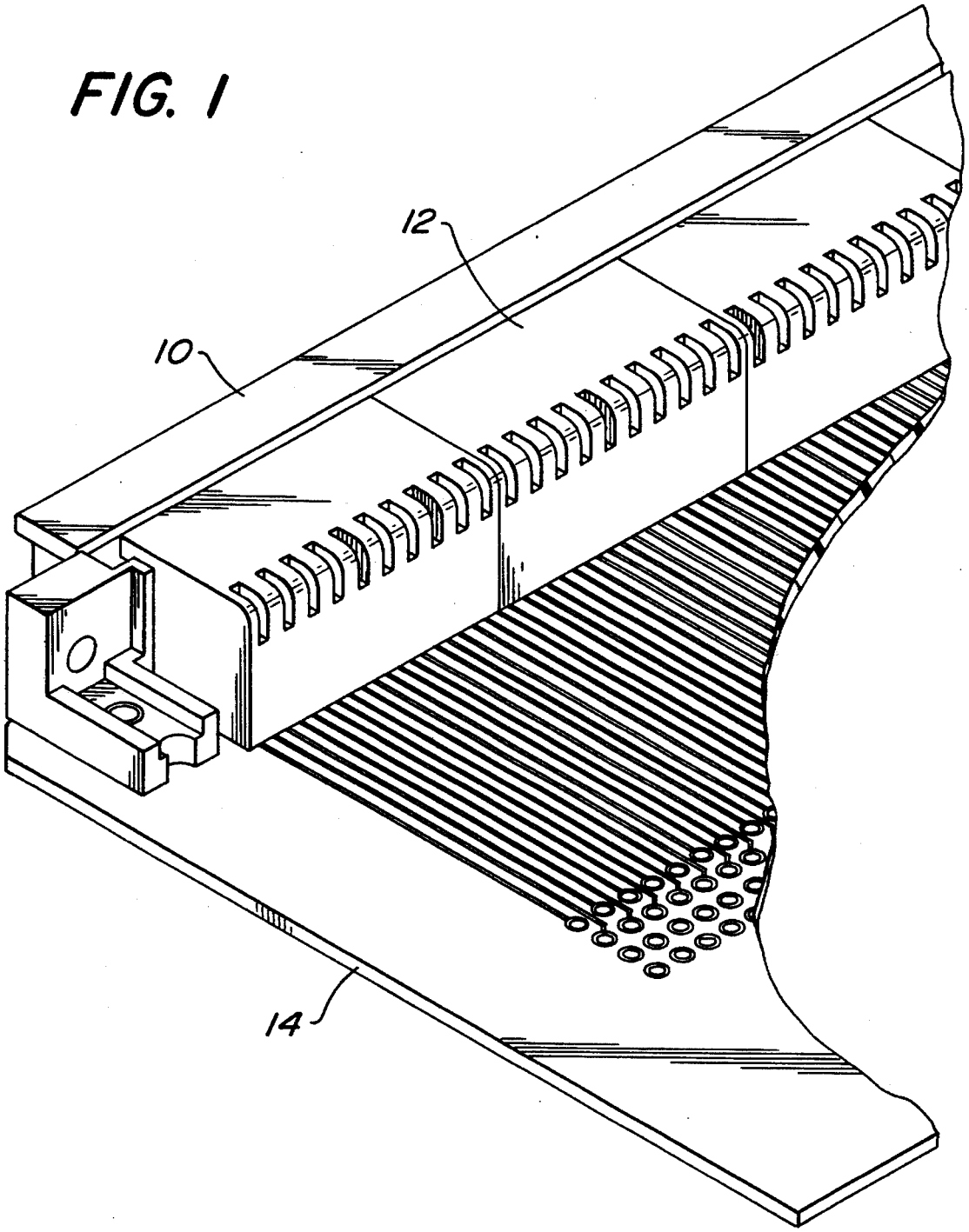
FIG. 1 is an isometric view of one embodiment of a right angle connector (receptacle) assembly in accordance with the present invention. This drawing depicts the receptacle inserted into the PCB.
Figure 2:
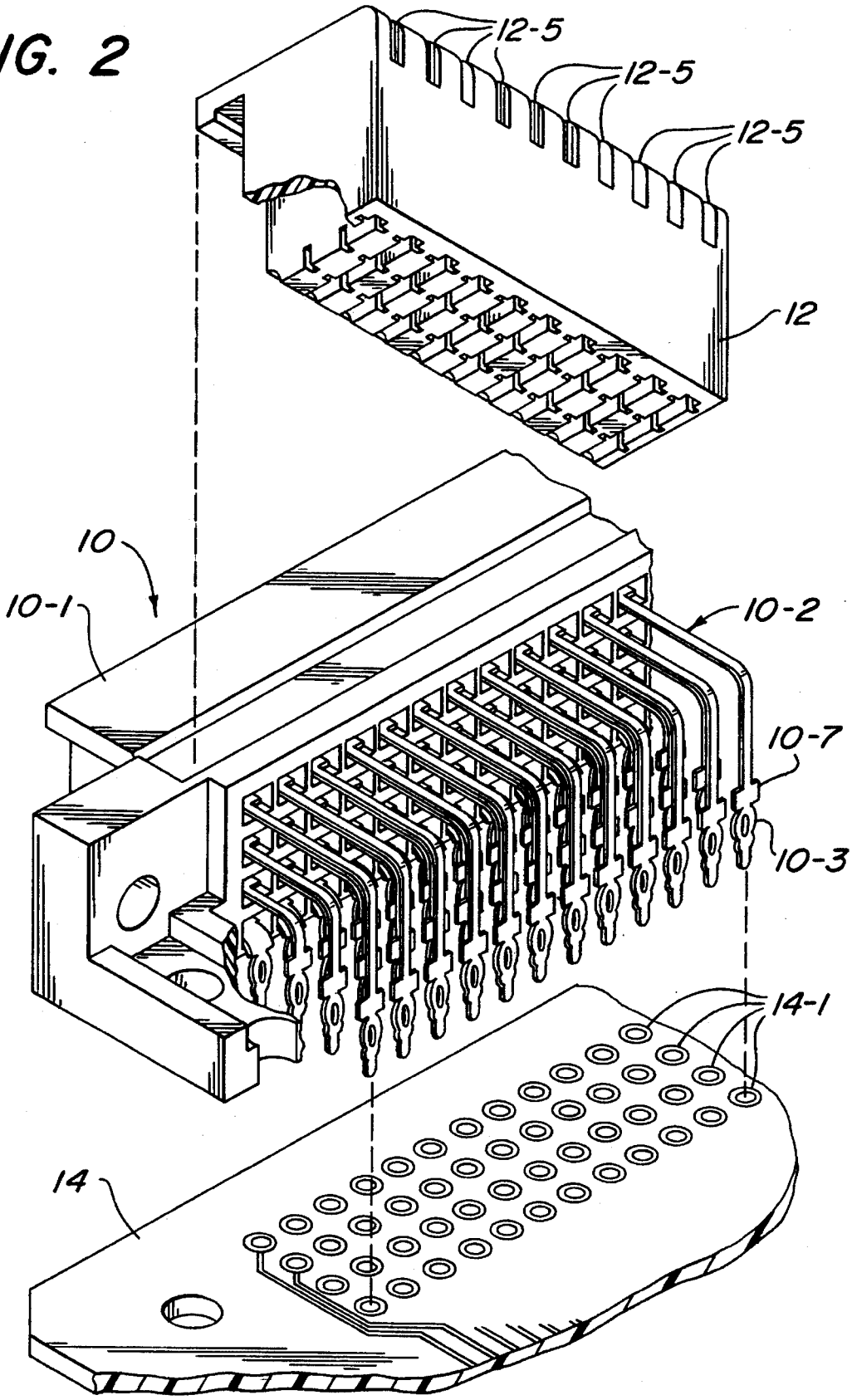
FIG. 2 is an exploded view of the connector assembly of FIG. 1.

FIG. 1 is an isometric view of one embodiment of a right angle connector assembly in accordance with the present invention. FIG. 1 depicts the connector assembly inserted into the mounting substrate. FIG. 2 is an exploded view of the assembly of FIG. 1. The connector assembly in this embodiment includes a receptacle 10 and a press block 12. As shown in FIG. 2, the mounting substrate 14 has conductive bore holes 14-1 for receiving pins 10-2 of the receptacle. In this example the substrate is a PCB.

Figure 3:
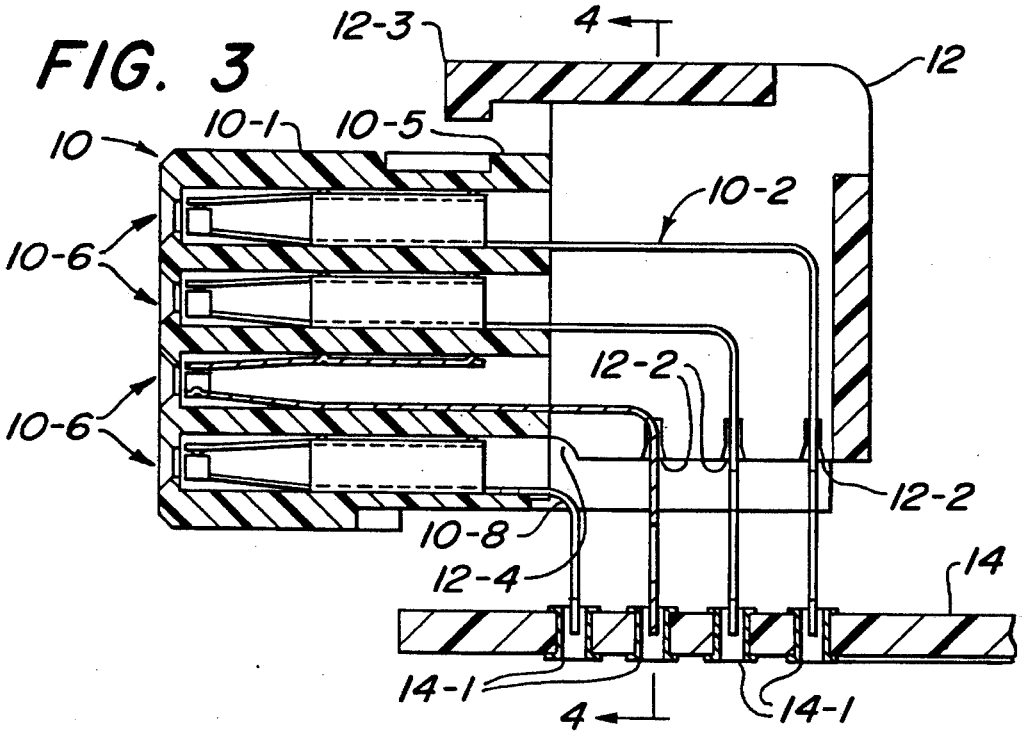
FIG. 3 is a side elevation cross-section view of the connector assembly before insertion into the PCB.
Figure 4:
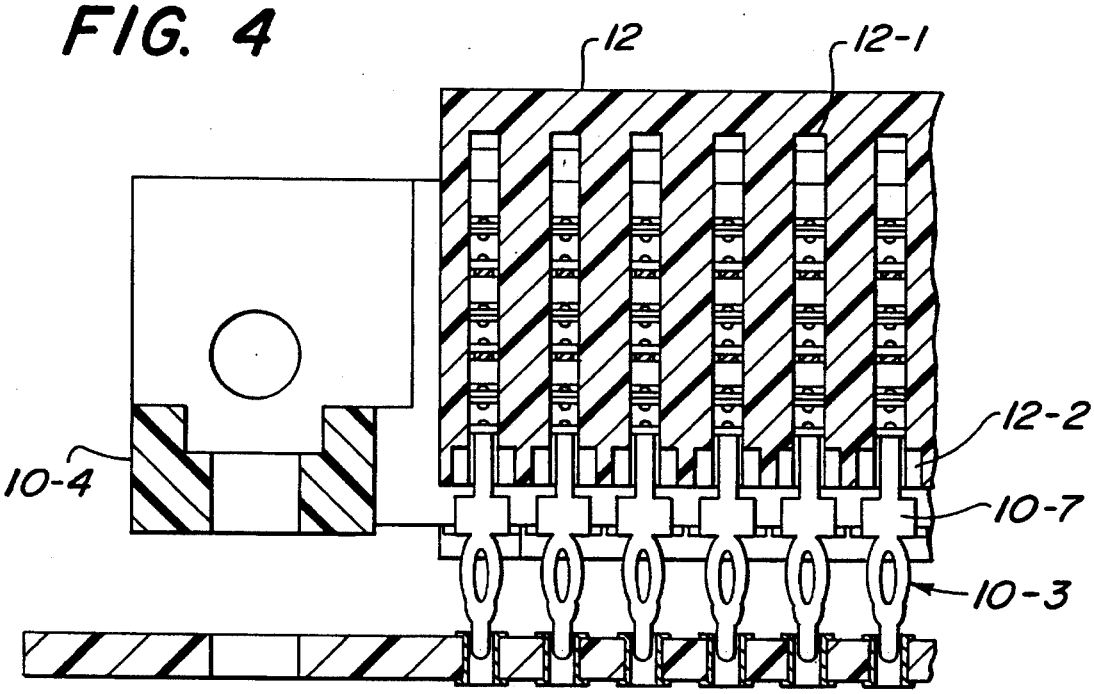
FIG. 4 is a front elevation cross-section view of the connector assembly before insertion into the PCB.
Figure 5:
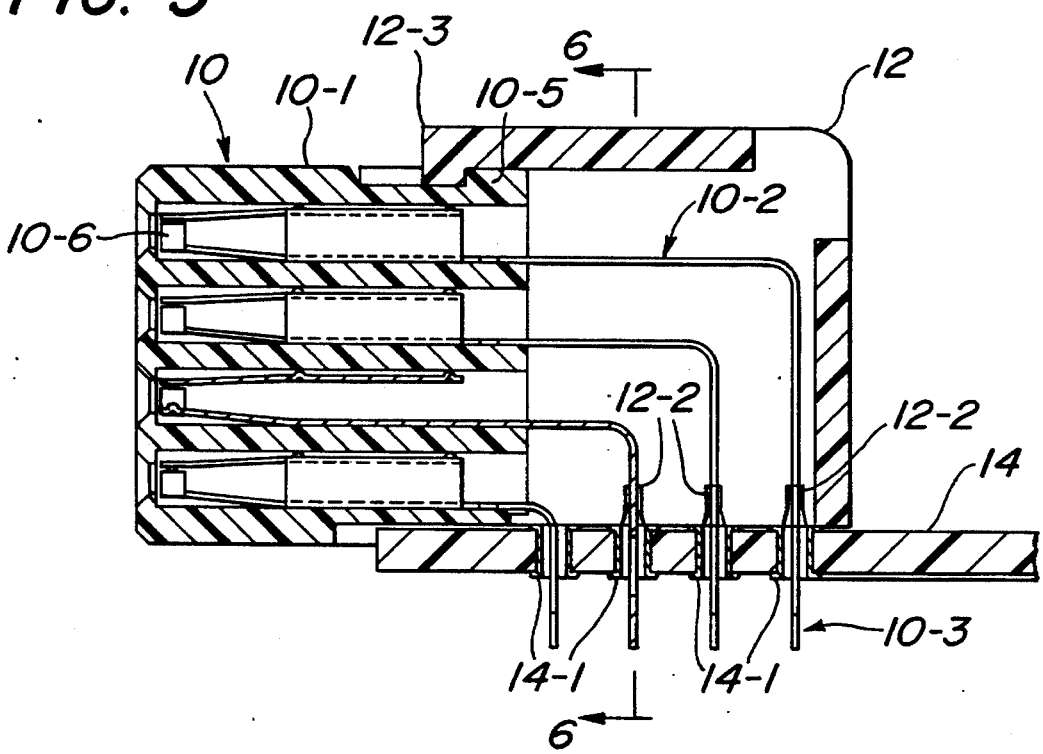
FIG. 5 is a side elevation cross-section view of the connector assembly after insertion into the PCB.
Figure 6:
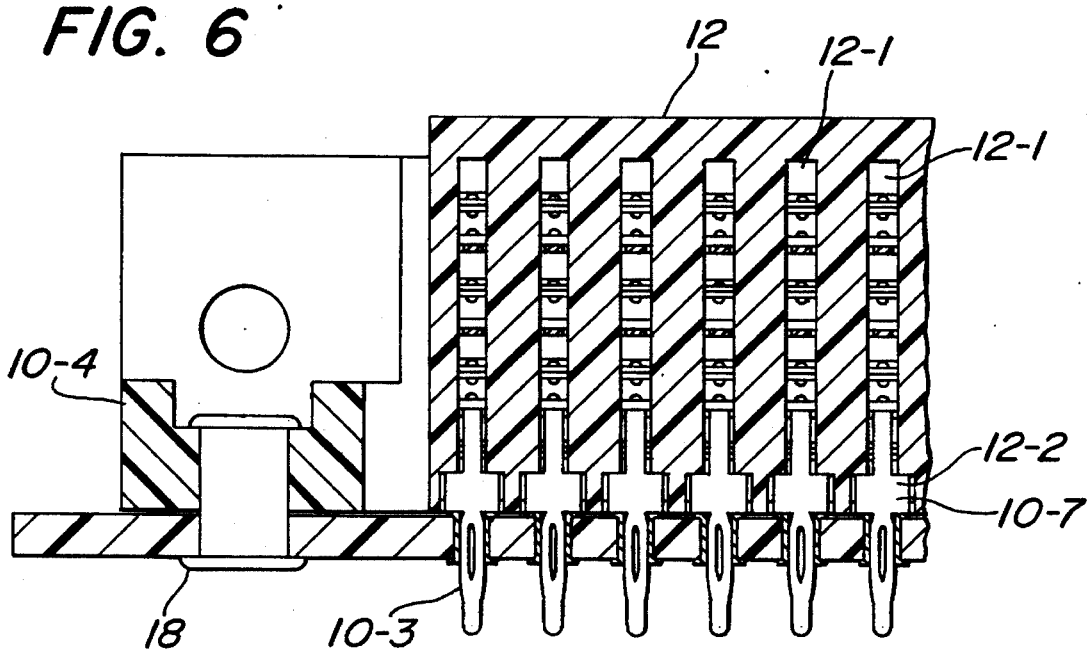
FIG. 6 is a front elevation cross-section view of the connector assembly after insertion into the PCB.

FIGS. 3 and 4 respectively depict side and front cross-sections of the connector assembly before insertion into the PCB. FIGS. 5 and 6 respectively depict side and front cross-sections of the connector assembly after insertion into the PCB. Referring now to FIGS. 1–6, the receptacle 10 comprises an insulative housing 10-1; a plurality of pins 10-2 arranged in a plurality of rows, in this example four rows; so-called "eye of the needle" compliant interfaces 10-3; a flange 10-4 for securing the receptacle to the PCB; a lip 10-5, which is adapted for hooking engagement with a hook portion 12-3 of the press block; a plurality of sockets 10-6, which are respectively electrically connected to the pins 10-2; load bearing T-shaped shoulders 10-7 formed in all but the row 1 pins near their ends, above the compliant interfaces 10-3. The row 1 pins are separately assigned the reference numeral 10-8 (see FIG. 4) because they differ from the other pins in that they do not include the shoulders 10-7.

The press block 12 comprises slots 12-1 each of which is adapted to receive a column of pins; recess or pocket portions 12-2, which are arranged to receive the respective shoulder portions 10-7 of the row 2, 3, and 4 pins; the hook section 12-3; and a curved surface 12-4 (see FIG. 3), for applying an insertion force to the row 1 pins 10-8. As mentioned above, the contact pins, or tails, in rows 2, 3, and 4 each have the T-shaped shoulder 10-7 (see FIG. 4). These shoulders are press fitted into the pockets 12-2 of the press block as the connector is installed on the PCB. This feature, which is best shown by FIG. 6, retains the press block on the pins. The hook engagement of the press block 12 to the connector body 10-1, provided by elements 12-3 and 10-5, prevents the press block from rocking downward and destroying the pin tip true position.

The insertion force is applied to the row 1 pins 10-8 by the curved surface 12-4, which has a radius matching the radius of the row 1 tails (e.g., 0.03 inch in one embodiment). This radius extends along the length of the press block and is interrupted by slots as necessary to accommodate the row 2, 3, and 4 tails. The row 1 press block slot is wider than the row 2-4 tails and narrower than the row 1 tails. This feature provides a bearing area on both sides of the row 1 tails. This bearing area transmits the required installation force to the row 1 tails.

An installation fixture in accordance with the present invention facilitates the installation of a connector onto a mounting substrate. The problem addressed by this fixture is illustrated by FIG. 7A–7C. FIG. 7A shows the connector, in this case the receptacle 10, placed onto the PCB 14 in alignment with the holes 14-1 thereof. As discussed above, the width of the interfaces 10-3 of the connector pins is greater than the diameter of the holes. Therefore, the connector is supported above the PCB to a height designated L1. FIG. 7B shows how the connector is unbalanced due to its uneven weight distribution. If the connector is temporarily supported parallel to the mounting substrate and a press is engaged, the connector pins 10-2 may buckle as shown in FIG. 7C. This can occur if the pins are not presented parallel to the axis of the substrate holes or if the insertion force exceeds the column strength of the pins.

Figure 7:
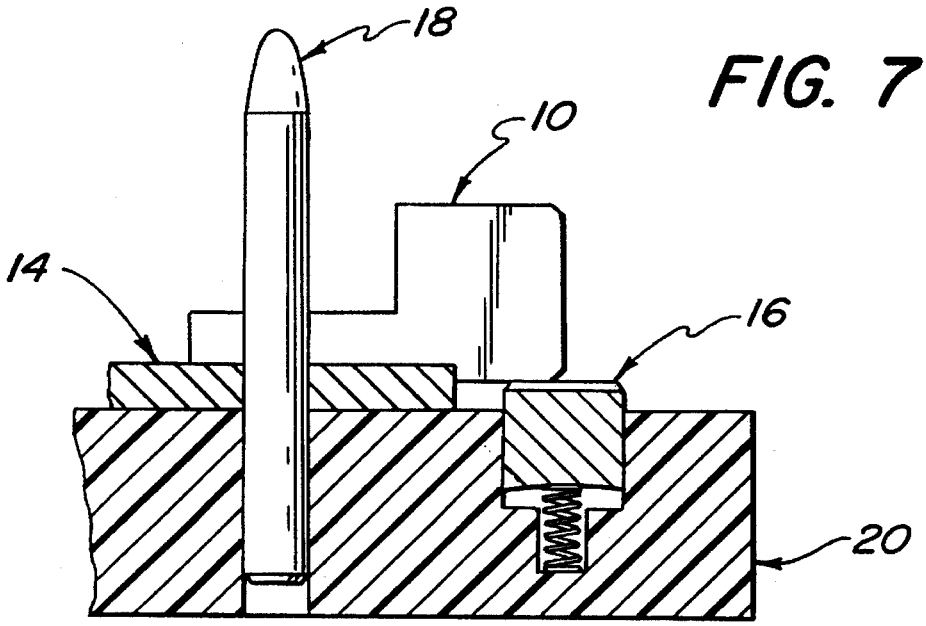
FIG. 7 is a schematic depiction of an installation fixture for a connector assembly in accordance with the present invention.

One embodiment of an installation fixture in accordance with the present invention is schematically depicted in cross-section by FIG. 7. As shown, the installation fixture includes a plate 20, a spring pad 16 supporting the connector nose (the portion extending beyond the PCB) and preventing it from tipping over prior to insertion, and a location pin 18 ensuring that the connector can only move in a vertical plane during installation. An alternative embodiment (not shown) substitutes a resilient pad (e.g., a foam rubber pad) for the spring plate.

Figure 8:
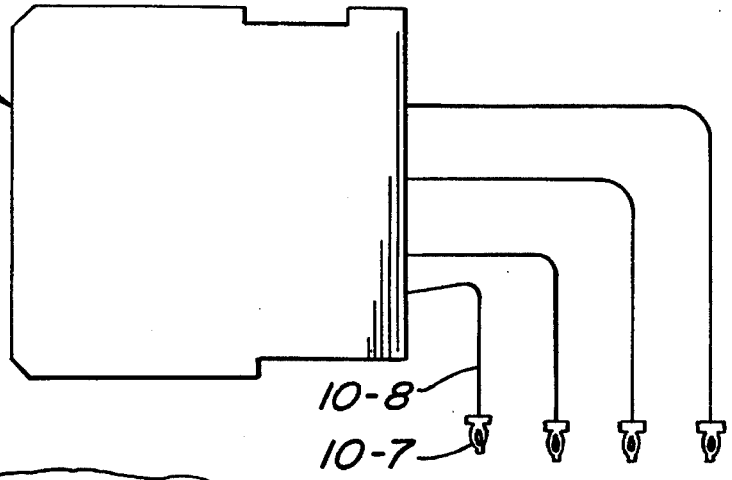
FIG. 8 is a schematic depiction of an alternative embodiment of the connector assembly.

FIG. 8 is a schematic depiction of an alternative embodiment of the connector assembly. In this embodiment, the row 1 pins 10-8 are lengthened and bent upward as shown. This makes these pins capable of supporting lateral load-bearing shoulders 10-7 of the kind formed in the pins of rows 2–4. With this embodiment of the receptacle, the press block 12 could advantageously be modified to include pockets 12-2 for receiving the shoulders of the row 1 pins.

Figure 9:
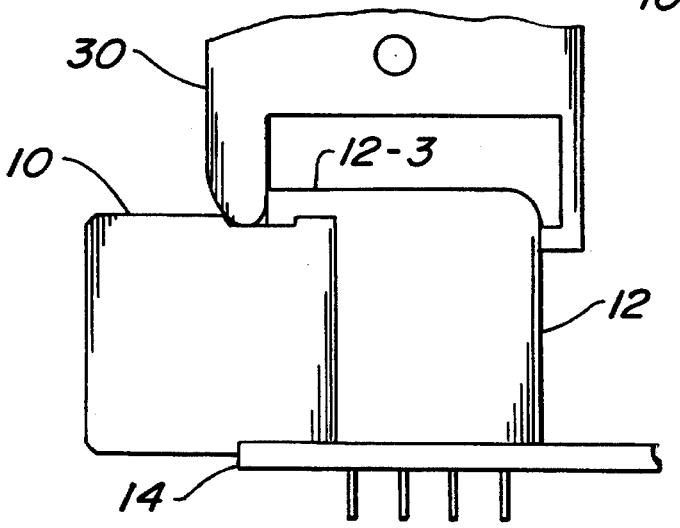
FIG. 9 schematically depicts a tool 30 removing or prying the second insulative housing 12 loose from the first insulative housing 10.

FIG. 9 depicts a "puller" tool 30 for removing second insulative housing 12 from the first insulative housing 10. As shown, e.g., in FIG. 2, the press block includes windows 12-5. Pins (not shown) in the puller 30 grasp the windows in the press block 12 and the puller uses the groove/lip on the receptacle 10 as a fulcrum to remove the press block.

The parts referred to throughout this specification can be made from known materials used to make similar conventional parts. For example, the insulative housings can be made of various plastics, such as polyetherimide resin or polyphenylene sulfide resin. Any conductive walls, bases, and shields can be made of any nonmagnetic metal or metal alloy including zinc, aluminum, copper, brass or alloys thereof. The contact elements can be made from any suitable metal used for electrical terminals, such as brass, phosphor bronze, beryllium copper and the like. The contact elements may be plated or coated with a conductive layer, such as tin, nickel, palladium, gold, silver or a suitable alloy.

Those skilled in the art, having the benefit of the teachings of this specification, may effect numerous modifications thereto. For example, the present invention is by no means limited to applications employing a right angle receptacle of the type described above, nor is the invention limited to connectors employing any specific pin counts. The connector, e.g., could include a plug as opposed to a receptacle. Accordingly, the scope of protection of the following claims is intended to encompass all embodiments incorporating the teachings of the present invention as defined in the claims.

What is claimed is:

1. A connector assembly capable of connection to a mounting substrate having bore holes, comprising:

(a) a first insulative housing;

(b) a plurality of contact pins each comprising a first section extending in a first direction from said first insulative housing, a second section oriented in a second direction which is generally perpendicular to said first direction, and a third section extending from said second section in said second direction, wherein said contact pins are arranged in a plurality of rows and said third section is formed to provide a compliant press fit engagement with a mounting substrate bore hole, wherein, in a first row, the respective contact pins are shoulderless; in a second row, the respective contact pins comprise a shoulder section interposed between the second and third sections, said shoulder section having a lateral dimension, extending in a direction perpendicular to the second direction, which is greater than a corresponding lateral dimension of the second section; and (c) a press block comprising a second insulative housing and slots formed in said second insulative housing to receive the respective contact pins and to apply an insertion force to said pins, .said press block including a corner surface having a radius matching a radius of the shoulderless pins, whereby an insertion force applied to said press block is transmitted to said shoulderless pins by said corner surface, wherein at least one of said contact pins in said second row is press-fitted into a slot in said press block, whereby said press block becomes attached to and part of the connector assembly.

2. A connector assembly as recited in claim 1, wherein said first insulative housing includes a lid and said second insulative housing of said press block comprises a hook engagement portion for engaging said lip in said first insulative housing.

3. A connector assembly as recited in claim 1, wherein said press block further comprises pocket portions formed in said slots and arranged for press fit engagement with respective shoulder sections, said pocket portions having a depth greater than the length of said shoulder sections, whereby a gap is formed between the shoulder sections and the mounting substrate, thereby avoiding the cutting or shearing of traces on said mounting substrate.

4. A connector assembly capable of connection to a mounting substrate having bore holes, comprising:

(a) a first insulative housing;

(b) a first plurality of contact pins arranged in a first row, each contact pin in said first row comprising a first section extending in a first direction from said first insulative housing, a second section oriented in a second direction which is generally perpendicular to said first direction, and a third section extending from said second section in said second direction, wherein said contact pins are arranged in a plurality of rows and said third section is formed to provide a compliant press fit engagement with a mounting substrate bore hole;

(c) a second plurality of contact pins arranged in a second row, each contact pin in said second row comprising: a first section extending in a third direction from said first insulative housing, said third direction being inclined relative to said first direction; a second section oriented in a second direction which is generally perpendicular to said first direction; and a third section extending from said second section in said second direction, wherein said contact pins are arranged in a plurality of rows and said third section is formed to provide a compliant press fit engagement with a mounting substrate bore hole; and (d) a press block comprising a second insulative housing and slots formed in said second insulative housing to receive the respective contact pins and to apply an insertion force to said pins, wherein at least one of said contact pins is press-fitted into said press block, whereby said press block becomes attached to and part of the connector assembly, and wherein said first insulative housing includes a lip forming a sidewall of a channel in said first insulative housing, and said second insulative housing of said press block comprises a hook engagement portion for engaging said lip in said first insulative housing, said hook engagement portion being narrower than the width of said channel.

5. A connector assembly as recited in claim 4, wherein, in said first and second rows, the respective contact pins comprise a shoulder section interposed between the second and third sections, said shoulder section having a lateral dimension, extending in a direction perpendicular to the second direction, which is greater than a corresponding lateral dimension of the second section.

6. A connector assembly as recited in claim 5, wherein said press block further comprises pocket portions formed in said slots and arranged for press fit engagement with respective shoulder sections.

7. A connector assembly capable of connection to a mounting substrate having bore holes and one or more electrically conductive traces, comprising:

(a) a first insulative housing;

(b) a plurality of contact pins each comprising a first section extending in a first direction from said first insulative housing, a second section oriented in a second direction which is generally perpendicular to said first direction, and a third section extending from said second section in said second direction, wherein said contact pins are arranged in a plurality of rows and said third section is formed to provide a compliant press fit engagement with a mounting substrate bore hole; and (c) a press block comprising a second insulative housing and windows and slots formed in said second insulative housing, said slots receiving the respective contact pins;

wherein, in a first row the respective contact pins comprise a shoulder section interposed between the second and third sections, said shoulder section having a lateral dimension extending in a direction perpendicular to the second direction, said lateral dimension being greater than a corresponding lateral dimension of the second section, and wherein said slots have a depth greater than the length of said shoulder section, whereby a gap is formed between the shoulder section and the mounting substrate, thereby avoiding the cutting or shearing of traces on said mounting substrate.

8. A connector assembly as recited in claim 7, wherein at least one of said contact pins is press-fitted into said press block, whereby said press block becomes attached to and part of the connector assembly.

9. A connector assembly capable of connection to a mounting substrate having bore holes and one or more electrically conductive traces, comprising:

(a) a first insulative housing;

(b) a plurality of contact pins each comprising a first section extending in a first direction from said first insulative housing, a second section oriented in a second direction which is generally perpendicular to said first direction, and a third section extending from said second section in said second direction, wherein said contact pins are arranged in a plurality of rows and said third section is formed to provide a compliant press fit engagement with a mounting substrate bore hole; and (c) a press block comprising a second insulative housing and windows and slots formed in said second insulative housing, said slots receiving the respective contact pins and said windows providing means for grasping said press block in removing said press block from said first insulative housing.

10. A connector assembly as recited in claim 9, wherein, in a first row the respective contact pins comprise a shoulder section interposed between the second and third sections, said shoulder section having a lateral dimension extending in a direction perpendicular to the second direction, said lateral dimension being greater than a corresponding lateral dimension of the second section, and wherein said slots have a depth greater than the length of said shoulder section, whereby a gap is formed between the shoulder section and the mounting substrate, thereby avoiding the cutting or shearing of traces on said mounting substrate.

* * * * *